US011631557B2

(12) United States Patent
Kirby et al.

(10) Patent No.: US 11,631,557 B2
(45) Date of Patent: Apr. 18, 2023

(54) ROTATIONAL OVER TRAVEL PROTECTION FOR PREVENTING OVER ROTATION OF AN OBJECT

(71) Applicant: Raytheon Company, Waltham, MA (US)

(72) Inventors: Bryce Kirby, Berlin, MA (US); Craig K. Johnson, Jr., Northborough, MA (US); Andrew A. Mcmahon, Milford, NH (US)

(73) Assignee: Raytheon Company, Waltham, MA (US)

( * ) Notice: Subject to any disclaimer, the term of this patent is extended or adjusted under 35 U.S.C. 154(b) by 169 days.

(21) Appl. No.: 17/174,298

(22) Filed: Feb. 11, 2021

(65) Prior Publication Data

US 2022/0254584 A1 Aug. 11, 2022

(51) Int. Cl.

| | |
|---|---|
| ***H01H 19/28*** | (2006.01) |
| ***H01H 21/28*** | (2006.01) |
| ***B66D 1/56*** | (2006.01) |

(52) U.S. Cl.

CPC ..... *H01H 21/285* (2013.01); *B66D 1/56* (2013.01)

(58) Field of Classification Search

CPC ..... H01H 21/285; H01H 3/40; H01H 19/62; H01H 19/18; H01H 13/186; H01H 3/168; H01H 3/16; H01H 19/14; H01H 19/11; H01H 19/585; H01H 19/58; H01H 19/635; H01H 19/64; H01H 19/63; H01H 19/005; H01H 19/10; H01H 1/2041; H01H 19/56; H01H 19/03; H01H 19/02; H01H 2019/006; H01H 19/00; H01H 19/20; H01H 19/001; H01H 21/50; H01H 2221/01; B66D 1/56

See application file for complete search history.

(56) References Cited

U.S. PATENT DOCUMENTS

| | | | |
|---|---|---|---|
| 2,566,824 A | 9/1951 | Carlson | |
| 6,864,439 B2 | 3/2005 | Chen | |

FOREIGN PATENT DOCUMENTS

| | | | | |
|---|---|---|---|---|
| AU | 2015268682 B2 | | 7/2016 | |
| CN | 110211822 | * | 9/2019 | ..... H01H 3/32 |
| DE | 8401578 U1 | | 4/1984 | |
| EP | 0967626 B1 | | 6/2005 | |
| EP | 3327740 A1 | | 5/2018 | |
| JP | S55-146636 U | | 10/1980 | |

(Continued)

OTHER PUBLICATIONS

International Search Report for International Application No. PCT/US2021/062983 dated Apr. 12, 2022, 29 pages.

*Primary Examiner* — Ahmed M Saeed

(57) ABSTRACT

A rotational over travel protection device for preventing over rotation of at least one of a cable, or a component operable with the rotational over travel protection device is provided. The device includes a housing, a rotatable shaft connected to the housing that can rotate relative to the house, and a triggering device supported in the housing and rotatable with the rotatable shaft. The device also includes a first and second rotational limit switch disposed in the housing. The switches are operable to be activated by the triggering device to arrest rotation of the rotatable shaft upon relative rotation of the rotatable shaft and the housing either a first or second rotation direction, respectively, at least 180 degrees from a zero position.

17 Claims, 4 Drawing Sheets

(56) References Cited

FOREIGN PATENT DOCUMENTS

| | | | |
|---|---|---|---|
| JP | S57-078542 | U | 5/1982 |
| JP | H09-189332 | A | 7/1997 |
| WO | WO 95/17643 | A1 | 6/1995 |

* cited by examiner

ROTATIONAL OVER TRAVEL PROTECTION FOR PREVENTING OVER ROTATION OF AN OBJECT

GOVERNMENT LICENSE RIGHTS

This invention was made with government support under contract No. W15QKN-20-9-1002 awarded by the US Army Contracting Command. The government has certain rights in the invention.

BACKGROUND

In many applications, electrical or communication signals are passed through components that have moving parts. For example, power and/or data transfer in some applications needs to travel from a stationary part to a rotating part within an assembly. Accordingly, there are solutions that provide for a connector to transmit electrical power and/or data from a stationary part to a moving part, such as a rotating part, within the assembly. Such connectors can be referred to as slip rings, rotary electrical interfaces, electrical rotatory joints, or the like. These connectors allow for both the relative rotation of parts as well as the transmission of electrical power and/or data.

However, the use of such connectors results in line loss in the power or data that is transmitted through these connectors. In some applications, such line loss is unacceptable for the functionality of the system. In such situations, instead of using a connector, a cable can be used between moving parts which twists along with the relative rotation between parts of an assembly. Of course, a cable has a limit to how much it can twist or rotate without being damaged. Thus, when using a cable between moving parts, it is important that the cable is not twisted past its mechanical limits. In addition, the rotation of the parts that rotate relative to one another should be limited so as to prevent any components that are operable with the relative rotating parts from rotating into fixed objects or other components within the assembly. Thus, there is a need to provide a way to prevent rotational over travel of a cable while still allowing the moving parts to rotate sufficiently in accordance with the needs of a given application.

BRIEF DESCRIPTION OF THE DRAWINGS

Features and advantages of the disclosed technology will be apparent from the detailed description which follows, taken in conjunction with the accompanying drawings, which together illustrate, by way of example, features of the disclosed technology; and, wherein.

Figure 1:
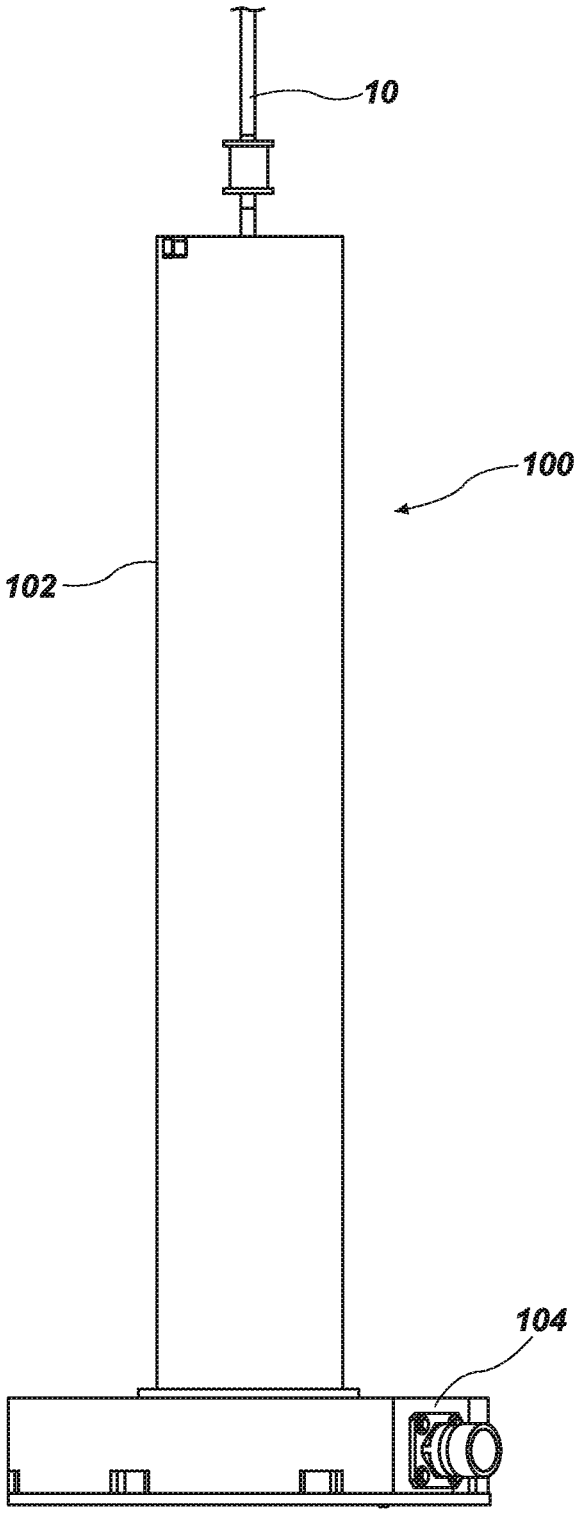
FIG. 1 is a front view of a rotational over travel protection device in accordance with an example of the present disclosure, the rotational over travel protection device comprising an exemplary housing connected with a rotatable shaft that comprises rotational over travel protection.

Reference will now be made to the exemplary embodiments illustrated, and specific language will be used herein to describe the same. It will nevertheless be understood that no limitation of the scope of the exemplary embodiments is thereby intended.

DETAILED DESCRIPTION

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

In one example, the present disclosure sets forth a rotational over travel protection device for preventing over rotation of an object, such as a cable, supported by the rotational over travel protection device, as well as preventing any components operable with (e.g., supported by, driven by) the shaft from over rotating such that they rotate into other components within the assembly incorporating the rotational over travel protection device, or into any fixed objects in the vicinity of the assembly. The rotational over travel protection device can comprise a housing and rotatable shaft connected to the housing. The rotatable shaft and the housing can be operable to rotate relative to one another. The rotational over travel protection device can further comprise a triggering device supported in the housing. The triggering device can be rotatable with the rotatable shaft through at least some rotational degrees of the rotatable shaft.

The rotational over travel protection device can further comprise a first rotational limit switch disposed in the housing. The first rotation limit switch can be operable to be activated by the triggering device to arrest rotation of the rotatable shaft upon relative rotation of the rotatable shaft and the housing in a first rotation direction greater than 180 degrees from a zero position. The rotational over travel protection device can also comprise a second rotational limit switch disposed in the housing. The second rotational limit switch can be operable to be activated by the triggering device to arrest rotation of the rotatable shaft upon relative rotation of the rotatable shaft and the housing in a second rotation direction greater than 180 degrees from the zero position where the second rotation direction is opposite the first rotation direction.

In one example, the first and second rotational limit switches and the triggering device are supported in a common plane. The triggering device can comprise a pawl operable to engage with a protrusion disposed on the rotatable shaft. The protrusion can engage the pawl after the shaft rotates substantially 180 degrees from the zero position in both the first rotation direction and the second rotation direction.

In some examples, the rotational over travel protection device can comprise a biasing member that biases (e.g., returns) the pawl in a neutral position when the pawl is not engaged with the protrusion. The biasing member can be a rotational spring interfaced with the triggering device.

In some examples, the triggering device can comprise a cam surface, and the first and second rotational limit switches can each comprise a cam follower. The triggering device can activate the first and second rotational limit switches upon the cam surface engaging the cam follower.

In some examples, the shaft can be associated with a first gear, and the triggering device comprise a second gear interfacing with the first gear. The triggering device can comprise first and second stops that interface with the first and second rotational limit switches. The first and second rotational limit switches can comprise face plungers.

In another example, a rotational over travel protection device for preventing over rotation of an object, such as a cable and/or any components operable with (e.g., supported by, driven by) the rotational over travel protection device is provided. The rotational over travel protection device can comprise a housing and a rotatable shaft connected to the housing. The rotatable shaft and the housing can be operable to rotate relative to one another. The rotational over travel protection device can also comprise a triggering device that is interfaced to the rotatable shaft and is configured to rotate in a rotational plane.

The rotational over travel protection device can comprise a first rotational limit switch disposed in the housing. The first rotational limit switch being can be disposed coplanar with the rotational plane of the triggering device. The rotational over travel protection device can also comprise a second rotational limit switch disposed in the housing. The second rotational limit switch can also be disposed coplanar with the rotational plane of the triggering device.

The triggering device can activate the first rotational limit switch to arrest rotation of the rotatable shaft upon a rotation of the rotatable shaft of greater than 180 degrees in a first rotation direction from a zero position relative to the housing. The triggering device can also activate the second rotational limit switch to arrest rotation of the rotatable shaft upon a rotation of the rotatable shaft of greater than 180 degrees in a second rotation direction from the zero position relative to the housing, where the second rotation direction is opposite the first rotation direction.

In some examples, the triggering device can comprise a pawl operable to engage with a protrusion disposed on the rotatable shaft. The protrusion can engage the pawl after the shaft rotates 180 degrees from the zero position in both the first rotation direction and the second rotation direction. Upon engagement of the protrusion of the shaft with the pawl of the triggering device, the triggering device rotates with the shaft.

In some examples, the rotational over travel protection device can comprise a biasing member that biases the pawl in a neutral position when the pawl is not engaged with the protrusion. The biasing member can be a rotational spring interfaced with the triggering device and the housing.

In some examples, the triggering device can comprise a cam surface, and the first and second rotational limit switches can each comprise a cam follower. The triggering device can activate the first and second rotational limit switches with the cam surface engaging the cam follower.

In some examples, the shaft can be associated (e.g., integrated) with a first gear, and the triggering device can comprise a second gear interfacing with the first gear. The triggering device can comprise first and second stops that interface with the first and second rotational limit switches, which in some examples, can comprise face plungers.

In another example, a method for providing rotational over travel protection for preventing over rotation of an object, such as a cable and/or any components operable with (e.g., supported by, driven by) the rotational over travel protection device is provided. The method can comprise rotating a shaft relative to a housing in a first direction at least 180 degrees from a zero position, rotating a triggering device to activate a first rotational limit switch to arrest further rotation of the shaft relative to the housing in the first direction at a predetermined rotational position, rotating the shaft relative to the housing in a second direction at least 180 degrees from the zero position and rotating the triggering device to activate a second rotational limit switch to arrest further rotation of the shaft relative to the housing in the second direction at a predetermined rotational position, wherein the triggering device, the first rotational limit switch, and the second rotational limit switch are supported in a common plane.

In some examples, the first and second rotational limit switches are activated by a cam follower on the first and second rotational limit switches interfacing with a cam surface of the triggering device.

In some examples, the shaft is associated with a first gear, and the triggering device is associated with a second gear interfacing with the first gear.

To further describe the present technology, examples are now provided with reference to the figures. With reference to FIG. 1, a rotational over travel protection device 100 is provided. The rotational over travel protection device 100 is operable to prevent the over rotation of an object, such as an object supported by, about, within, or otherwise operable with the rotational over travel protection device 100. In one example, the object can comprise a cable 10, such as a fiber optic cable, supported by the rotational over travel protection device 10. In one example, the cable 10 can be supported via a connector or connector assembly supported within the rotational over travel protection device 100. The connector or connector assembly can be supported by the housing 104, wherein the cable 10 is routed through the shaft 102 and connected to the connector or connector assembly via a mating connector on the cable 10. In another example, the object can comprise one or more components operable with (e.g., supported by, driven by) the rotational over travel protection device 100 (e.g., the shaft as discussed below), wherein the rotational over travel protection device 100 can operate to prevent such components from rotating into any fixed object or into any other objects that might be in the vicinity of the rotational over travel protection device 100, or into any other components within an assembly incorporating the rotational over travel protection device 100. The rotational over travel protection device 100 comprises two components that rotate relative to one another and that support the cable 10 and/or rotating components. The cable 10 extends from one component to the other which causes the cable 10 to twist with the rotation of the two components. As shown in FIG. 1, the rotational over travel protection device 100 comprises components that rotate relative to one another in the form of a shaft 102 that is rotatable relative to a housing 104. Although not shown, one or more components can be coupled or otherwise supported by the shaft 102, so as to be driven (i.e., rotated) by the shaft 102 upon actuated rotation of the shaft 102.

The shaft 102 and the housing 104 shown in FIG. 1 are exemplary of two parts that rotate relative to one another as part of the rotational over travel protection device 100. However, those skilled in the art will recognize other rotatable parts that can be used as part of the rotational over travel protection device 100, and therefore the shaft 102 and housing 104 are not intended to be limiting in any way. For example, the rotational over travel protection device 100 can be used to limit rotation of a rotating pedestal, a turn table, a rotatable display, or any others. Regardless of the form, the shaft 102 is rotatable relative to the housing 104 which causes twist in the cable 10, and any components driven by the shaft 102 to be rotated.

Figure 2:
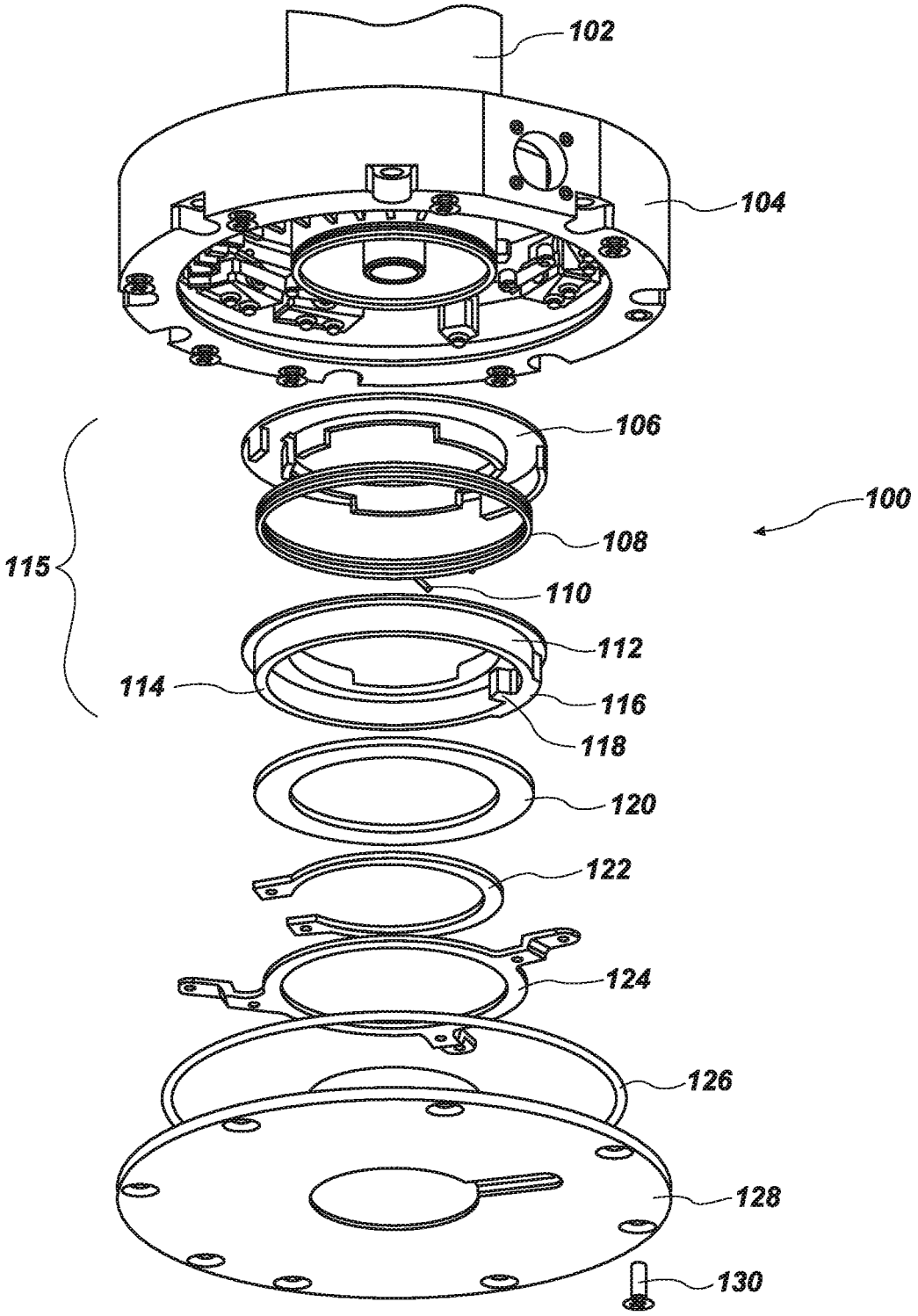
FIG. 2 is an isometric exploded view of components of the rotational over travel protection device of FIG. 1.

With reference to FIG. 2, the shaft 102 interfaces with the housing 104 and is rotatable relative to the housing 104. Within the housing 104 is an upper spring mount 106, a rotational spring 108, and a lower spring mount 112. The upper spring mount 106, rotational spring 108, and lower spring mount 112 collectively defining a triggering device 115 operable to activate over rotation protection, as will be described in more detail below. The upper spring mount 106 and lower spring mount 112 together house the rotational spring 108. The rotational spring 108 comprises one or more protruding ends 110 that are configured to interface with the housing 104 to secure a position of the rotational spring 108. The interfacing of the rotational spring 108 with the housing 104 is provided to bias the triggering device 115 into a neutral position. The rotational spring 108 is just one example of a biasing member used to bias the triggering device 115 into a neutral position. Those skilled in the art will recognize that other biasing members or mechanisms can also be used, such as other types of springs.

The lower spring mount 112 includes an annular side wall 114. The annular side wall 114 comprises a raised cam surface 116 on an exterior surface of the annular side wall 114. The raised cam surface 116 is operable to facilitate activation of the rotational over travel protection device 100 to provide over rotation protection, as will be described in more detail below. The annular side wall 114 further comprises a pawl 118 on an interior surface of the annular side wall 114. The pawl 118 is sized and configured to interface with the shaft 102 to cause rotation of the triggering device 115 when the protrusion 118 engages with the shaft 102.

The rotational over travel protection device 100 further comprises a washer 120, snap ring 122, and cable management member 124 that are disposed in and supported by the housing 104. The housing 104 is closed via an O-ring 126 and a cover 128. The cover 128 can be connected to the housing 104 and can compress the O-ring 126 via fasteners 130.

Figure 3C:
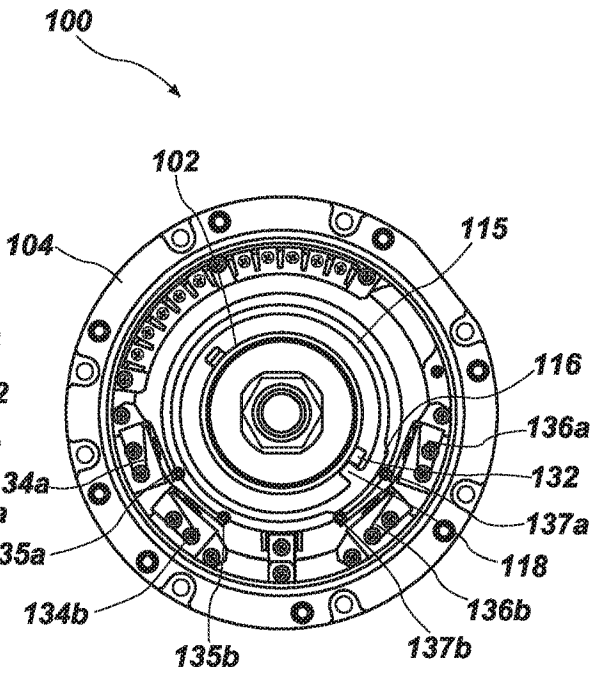
FIG. 3C is a bottom view of the rotational over travel protection device of FIG. 1 with the bottom cover removed showing the rotational over travel protection device in a second activated position.
Figure 3B:
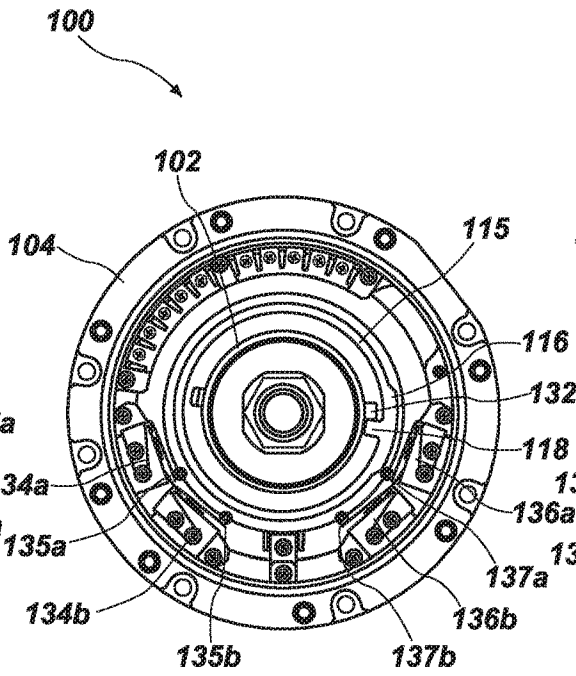
FIG. 3B is a bottom view of the rotational over travel protection device of FIG. 1 with the bottom cover removed showing the rotational over travel protection device in a first activated position.
Figure 3A:
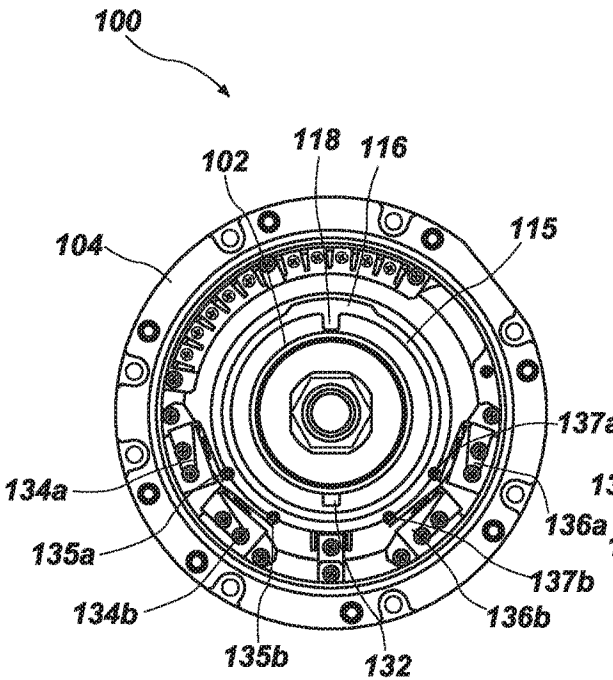
FIG. 3A is a bottom view of the rotational over travel protection device of FIG. 1 with a bottom cover removed showing the rotational over travel protection device in a neutral position.

Referring now to FIGS. 3A-3C, described is the operation of the rotational over travel protection device of FIGS. 1-2 to provide over rotation protection, and a method for providing rotational over travel protection for preventing over rotation of a cable and/or any components being driven that are associated with the rotational over travel protection device. The shaft 102 comprises a protrusion 132 disposed on an outer surface of the shaft 102. In FIG. 3A, the protrusion 132 and the shaft 102 are shown in a zero position or a reference position relative to the housing 104. In the zero or reference position, a cable (such as cable 10 shown in FIG. 1) that extends from the housing 104 to the shaft 102 is in a neutral or an untwisted state. Likewise, in FIG. 3A, the triggering device 115 is biased by a biasing member (such as rotational spring 108 shown in FIG. 2) in a neutral position. In this example, the neutral position of the pawl 118 of the triggering device 115 is disposed approximately 180 degrees from the protrusion 132 of the shaft 102 at the zero position. Or in other words, the neutral position of the pawl 118 of the triggering device 115 is located on an opposite side of the shaft 102 from the protrusion 132 when the shaft 102 is in the zero position.

Because the pawl 118 of the triggering device 115 is located 180 degrees from the zero position of the protrusion 132, the shaft 102 can rotate relative to the housing 104 substantially or approximately 180 degrees in each direction prior the protrusion 132 of the shaft 102 engaging with the pawl 118 of the triggering device 115. In other words, the shaft 102 rotates without engaging the triggering device 115 over at least some rotational range or degrees. Upon further and sufficient rotation of the shaft 102, the protrusion 132 of the shaft can engage the pawl 118, wherein the triggering device 115 is caused to simultaneously rotate with the shaft 102 through an additional range of rotation. In other words, the triggering device 115 rotates with the shaft 102 over at least some of the rotational range or degrees of the shaft 102 relative to the housing 104. Rotation of the triggering device 115 with the shaft 102 to one or more pre-determined rotational degrees from its neutral position functions to facilitate the arrest of further rotation of the shaft 102, thus preventing over rotation of the shaft 102 relative to the housing 104. As indicated herein, over rotation protection can be for the purpose of protecting over rotation of the cable 10 to prevent damage or degraded performance of the cable 10. In another aspect, this can be for the purpose of limiting the rotation of one or more components coupled or otherwise supported and driven by the shaft 102 so that the one or more components are prevented from rotating into other fixed components in an assembly incorporating the rotational over travel protection device, or to one or more components in the vicinity of the assembly. Preventing over rotation of a cable is discussed primarily herein, but this merely to illustrate one exemplary application where over rotation between two structures is to be limited.

When the shaft 102 rotates relative to the housing 104, the protrusion 118 also rotates from the zero position. In this example, the shaft 102 can rotate in either direction from the zero position. The shaft 102 can be rotated by a motor, for example. The motor controlling the speed and position of the rotation of the shaft 102 can be operated by a controller based on a user input, control instructions such as software, or the like.

The rotational over travel protection device further comprises a first pair of rotational limit switches 134*a*, 134*b* and a second pair of rotational limit switches 136*a*, 136*b*. Each of the first pair of rotational limit switches 134*a*, 134*b* comprises a cam follower (or cam follower surface) (see cam followers 135*a*, 135*b*, respectively) that can be sized and configured to activate the first pair of rotational limit switches 134*a*, 134*b*. Similarly, each of the second pair of rotational limit switches 136*a*, 136*b* comprises a cam follower (see cam followers 137*a*, 137*b*, respectively) sized and configured to activate the second pair of rotational limit switches 136*a*, 136*b*.

The first and second pairs of rotational limit switches 134*a*, 134*b*, 136*a*, 136*b* are operable to limit rotation of the shaft 102 relative to the housing 104 to prevent over travel of the shaft 102 relative to the housing 104. This prevents over rotation of a cable extending from the shaft 102 to the housing 104 (or over rotation of one or more components supported and driven by the shaft 102). Activation of the switches 134*a*, 134*b*, 136*a*, 136*b* can limit rotation by sending overriding control signals or instructions to a motor to stop or reverse rotation, by cutting power to a motor, by applying a brake, or through other control, electronic, or mechanical techniques.

In this example, the first and second pairs of rotational limit switches 134*a*, 134*b*, 136*a*, 136*b* provide primary and redundant mechanisms to ensure over travel of the shaft 102 relative to the housing 104 is prevented. For example, the first pair of rotational limit switches 134*a* 134*b* can include an initial limit switch 134*a* (or a first limit switch in the first pair of limit switches) and a final limit switch 134*b* (or a second switch in the first pair of limit switches). The initial limit switch 134*a* can be operable to send overriding control instructions to a motor to stop rotation of the shaft 102 relative to the housing 104, for example. In the event that the initial limit switch 134*a* fails to stop the relative rotation of the shaft 102 and the housing 104, the final limit switch 134*b* can be operable to cut power to the motor to ensure no further rotation of the shaft 102 relative to the housing 104, for example.

Likewise, the second rotational limit switches 136*a* 136*b* can include an initial limit switch 136*a* (a first limit switch in the second pair of limit switches) and a final limit switch 136*b* (a second limit switch in the second pair of limit switches). The initial limit switch 136*a* can be operable to send control instructions to a motor to stop rotation of the shaft 102 relative to the housing 104, for example. In the event that the initial limit switch 136*a* fails to stop the relative rotation of the shaft 102 and the housing 104, the final limit switch 136*b* can be operable to cut power to the motor to ensure no further rotation of the shaft 102 relative to the housing 104, for example. The redundant final or second rotational limit switch in each of the first and second pairs of rotational limit switches can be referred to as a backup rotational limit switch.

While the above example shows the two pairs of rotational limit switches 134*a*, 134*b*, 136*a*, 136*b*, other examples can exclude the redundancy and only include one of the first pair of rotational limit switches 134*a*, 134*b* and one of the second pair of rotational limit switches 136*a*, 136*b*, depending on the requirements for a given application. In other examples, the pairs of rotational limit switches 134*a*, 134*b*, 136*a*, 136*b*, can be used for different purposes. For example the initial limit switches 134*a*, 136*a* can be used to limit a rotational speed of the shaft 102 relative to the housing 104, and the final limit switches 134*b*, 136*b* can arrest any further rotation of the shaft 102 relative to the housing 104.

Advantageously, the triggering device 115, the protrusion 118 of the shaft 102, and the first and second rotational limit switches 134*a*, 134*b*, 136*a*, 136*b* can all be supported in the same plane. In this example, the plane can be defined by the rotational plane in which the triggering device 115 rotates. This allows the packaging and/or size of the rotational over travel protection device to remain small. At the same time, the rotational over travel protection device 100 allows for rotation of the shaft 102 relative to the housing to be greater than 180 degrees in each direction from the zero position. Thus, the rotational over travel protection device can be both compact and allow a wide range of rotational movement.

As shown in FIG. 3B, the shaft 102 can rotate relative to the housing 104. In this example, the shaft 102 is shown to have rotated clockwise 270 degrees from the zero position (as shown in FIG. 3A). As is shown with this exemplary number of degrees of rotation of the shaft 102, the protrusion 132 of the shaft 102 is engaged with the pawl 118 of the triggering device 115, wherein the triggering device 115 is caused to rotate with the shaft 102 from its neutral position as shown in FIG. 3A. That is, the protrusion 132 of the shaft 102 rotates independently until it has rotated 180 degrees, at which point it engages with the pawl 118 of the triggering device 115. The shaft 102 and triggering device 115 then rotate together as the shaft 102 rotates past 180 degrees from the zero position.

In this example, when the protrusion 132 of the shaft 102 reaches 270 degrees, the cam surface 116 of the triggering device 115 engages with the cam follower 137*a* of the initial rotational limit switch 136*a*. This activates the initial rotational limit switch 136*a* to prevent further rotation of the shaft 102 relative to the housing 104, such as by sending an overriding control instruction to a motor to stop further clockwise rotation of the shaft 102 relative to the housing 104.

While not explicitly shown, the shaft 102 can also rotate counter-clockwise from the zero position, such that the protrusion 132 of the shaft 102 engages with the pawl 118 to rotate the triggering device 115 until the cam surface 116 engages the cam follower 135*a* of the initial rotational limit switch 134*a* (also located at 270 degrees in this example) to prevent further rotation in the counter-clockwise direction.

When the shaft 102 returns back to an angle that is less than 180 degrees from the zero position, the triggering device 115 disengages from the protrusion 132 of the shaft 102 and is biased back to its neutral position. The shaft 102 can be further rotated to the position in FIG. 3A to place the protrusion 132 of the shaft 102 in the zero position with the pawl 118 again oriented 180 degrees from the protrusion 132 of the shaft 102. The triggering device 115 is biased to this position via a biasing member of the triggering device 115 (such as via the rotational spring 108 shown in FIG. 2).

In this example using redundant rotational limit switches, in the event that the activation of either of the initial limit switches 134*a*, 136*a* fails, further rotation of the shaft 102 relative to the housing 104 in the respective directions to engage these, can trigger the activation of the final limit switches 134*b*, 136*b*. As shown in FIG. 3C, assuming the failure of the first or initial rotational limit switch 136*a*, the protrusion 132 has rotated clockwise past 270 degrees from the zero position to a position approximately 300 degrees. With the triggering device 115 simultaneously moving with the rotating shaft 102 due to the interface between the protrusion 132 and the pawl 118, further rotation in the same direction causes the cam surface 116 of the triggering device 115 to engage with the cam follower 137*b* of the final rotational limit switch 136*b* to activate the final rotational limit switch 136*b*. In one example, activation of the final rotational limit switch 136*b* can result in electrical power being cut off to the motor, and/or can cause a brake to be applied to the shaft 102, such that further rotation of the shaft 102 in the clockwise direction is prevented.

Likewise, though not explicitly shown, if the protrusion 132 has rotated counter-clockwise past 270 degrees from the zero position, assuming failure of the rotational limit switch 134*a*, the final rotational limit switch 134*b* (in this example being located at 300 degrees) can be activated via the cam surface 116 of the triggering device 115.

Thus, in the above example, the rotational over travel protection device 100 can prevent the over rotation of a cable extending from the shaft 102 to the housing 104 (and/or over rotation of one or more components supported and driven by the shaft 102). The rotational over travel protection device 100 can further be compact while simultaneously allowing rotation greater than 180 degrees in each direction from a zero position.

Other variations are also contemplated. For example, in applications where there are less significant space constraints, the initial rotational limit switches 134*a*, 134*b* can be offset in a different plane from the final rotational limit switches 136*a*, 136*b*, and the triggering device 115 can rotate on an inclined plane or screw. This can potentially allow for greater than 360 degree rotation of the shaft 102 relative to the housing 104 if mechanical constraints of the cable (and/or supported components) allow.

Further, while the triggering device 115 and the rotational limit switches 134*a*, 136*a* are shown to limit rotation of the shaft 102 relative to the housing 104 to 270 degrees from a zero position, other rotational limits (i.e., other limited rotational degrees of rotation) larger or smaller than these can be set based on the needs of a given application, such as the mechanical limits of a particular cable, or due to space constraints of one or more components supported and driven by the shaft 102 relative to one or more other components, such as fixed components within an assembly.

Figure 4:
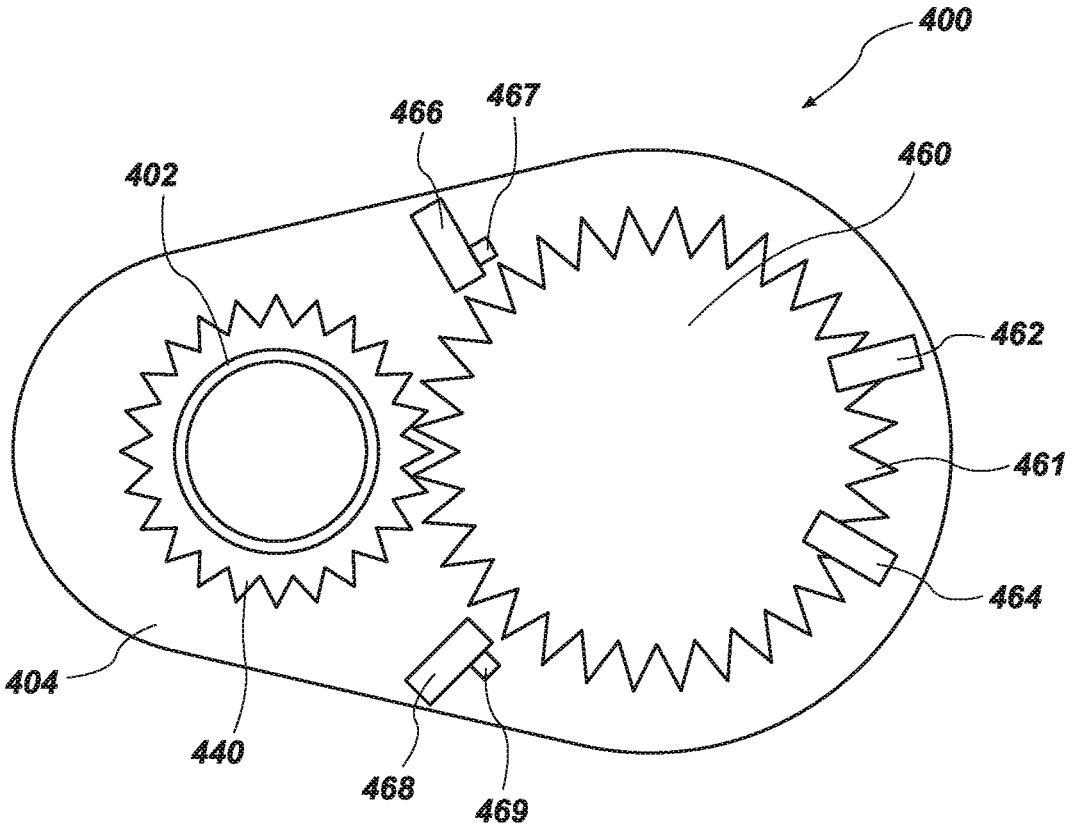
FIG. 4 shows a schematic view of a rotational over travel protection device in accordance with an example of the present disclosure.

Another example of a rotational over travel protection device is shown with respect to FIG. 4. In FIG. 4, a rotational over travel protection device 400 comprises a shaft 402 that is rotatable with respect to a housing 404 in a similar manner as discussed above. In this example, the shaft 402 is associated (e.g., integrated) with a first gear 440. The first gear 440 can be sized and configured to interface with a triggering device 460 that comprises a second gear 461. The triggering device 460 comprises a first stop 462 and a second stop 464 that are operable to activate a first rotation limit switch 466 and a second rotational limit switch 468, respectively. In this example, the first and second stops 462, 464 interface with respective plungers 467, 469 disposed on the first and second rotation limit switches 466, 468. The plungers 467, 469 activate the first and second rotational limit switches 466, 468, respectively, which can provide a similar function similar to the rotational limit switches discussed above to prevent further rotation of the shaft 402 relative to the housing 404.

The relative size of the first gear 440 with the second gear 461, and the placement of the stops 462, 464 and/or the first and second rotational limit switches 466, 468 can be determined based on the desired limits of rotation of the shaft 402 from a zero position. The gear reduction between the first gear 440 and second gear 461 can allow for rotation of the shaft 402 of greater than 180 degrees in each direction from a zero position. Further, in the example shown in FIG. 4, the first gear 440, the triggering device 460, and the first and second rotational limit switches 466, 468 are advantageously located on or otherwise supported in a common plane, allowing the rotational over travel protection device 400 to remain compact.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The use of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A rotational over travel protection device, comprising:

a housing;

a rotatable shaft connected to the housing, the rotatable shaft and the housing being operable to rotate relative to one another;

a triggering device supported in the housing and rotatable with the rotatable shaft through at least some rotational degrees of the rotatable shaft, the triggering device comprising an annular side wall having an exterior surface and an interior surface wherein the interior surface comprises a pawl operable to engage with a protrusion disposed on the rotatable shaft;

a first rotational limit switch disposed in the housing and operable to be activated by the exterior surface of the triggering device to arrest rotation of the rotatable shaft upon relative rotation of the rotatable shaft and the housing in a first rotation direction greater than 180 degrees from a zero position; and a second rotational limit switch disposed in the housing and operable to be activated by the exterior surface of the triggering device to arrest rotation of the rotatable shaft upon relative rotation of the rotatable shaft and the housing in a second rotation direction greater than 180 degrees from the zero position, the second rotation direction being opposite the first rotation direction.

2. The rotational over travel protection device of claim 1, wherein the first and second rotational limit switches and the triggering device are supported in a common plane.

3. The rotational over travel protection device of claim 1, wherein the protrusion engages the pawl after the shaft rotates substantially 180 degrees from the zero position in both the first rotation direction and the second rotation direction.

4. The rotation over travel protection device of claim 3, further comprising a biasing member that biases the pawl to a neutral position with the pawl disengaged with the protrusion.

5. The rotation over travel protection device of claim 4, wherein the biasing member comprises a rotational spring interfaced with the triggering device and the housing.

6. The rotational over travel protection device of claim 1, wherein the exterior surface of the triggering device comprises a raised cam surface and the first and second rotational limit switches each comprise a cam follower, and the triggering device is configured to activate the first and second rotational limit switches upon the raised cam surface engaging the cam follower.

7. The rotational over travel protection device of claim 1, further comprising:

a first final limit switch disposed in the housing and operable to be activated by the exterior surface of the triggering device to arrest rotation of the rotatable shaft when the first rotational limit switch fails, and a second final limit switch disposed in the housing and operable to be activated by the exterior surface of the triggering device to arrest rotation of the rotatable shaft when the second rotational limit switch fails.

8. The rotational over travel protection device of claim 7, wherein activation of the first final limit switch or the second final limit switch results in electrical power being cut off to a motor that rotates the rotatable shaft.

9. The rotational over travel protection device of claim 7, wherein activation of the first final limit switch or the second final limit switch results in a brake being applied to the rotatable shaft.

10. A rotational over travel protection device, comprising:

a housing;

a rotatable shaft connected to the housing, the rotatable shaft and the housing being operable to rotate relative to one another;

a triggering device comprising an annular side wall having an exterior surface and an interior surface wherein the interior surface comprises a pawl operable to engage with a protrusion disposed on the rotatable shaft, the triggering device being configured to rotate in a rotational plane;

a first rotational limit switch disposed in the housing, the first rotational limit switch being disposed coplanar with the rotational plane of the triggering device; and a second rotational limit switch disposed in the housing, the second rotational limit switch being disposed coplanar with the rotational plane of the triggering device;

wherein the external surface of the triggering device activates the first rotational limit switch to arrest rotation of the rotatable shaft upon a rotation of the rotatable shaft greater than 180 degrees in a first rotation direction from a zero position relative to the housing, and wherein the external surface of the triggering device activates the second rotational limit switch to arrest rotation of the rotatable shaft upon a rotation of the rotatable shaft greater than 180 degrees in a second rotation direction from the zero position relative to the housing, the second rotation direction being opposite the first rotation direction.

11. The rotational over travel protection device of claim 10, wherein upon engagement of the protrusion of the shaft with the pawl of the triggering device, the triggering device rotates with the shaft.

12. The rotational over travel protection device of claim 11, wherein the protrusion engages the pawl after the shaft rotates substantially 180 degrees from the zero position in both the first rotation direction and the second rotation direction.

13. The rotation over travel protection device of claim 12, further comprising a biasing member that biases the pawl in a neutral position when the pawl is not engaged with the protrusion.

14. The rotation over travel protection device of claim 13, wherein the biasing member comprises a rotational spring interfaced with the triggering device and the housing.

15. The rotational over travel protection device of claim 10, wherein the external surface of the triggering device comprises a raised cam surface and the first and second rotational limit switches each comprise a cam follower, and the triggering device activates the first and second rotational limit switches upon the raised cam surface engaging the cam follower.

16. A method for providing rotational over travel protection for an object, the method comprising:

rotating a shaft relative to a housing in a first direction at least 180 degrees from a zero position to engage a protrusion disposed on the rotatable shaft with a pawl on an interior surface of an annular side wall of a triggering device;

rotating the triggering device to activate a first rotational limit switch with an exterior surface of the triggering device to arrest further rotation of the shaft relative to the housing in the first direction at a predetermined rotational position;

rotating the shaft relative to the housing in a second direction at least 180 degrees from the zero position to engage the protrusion disposed on the rotatable shaft with the pawl on the interior surface of the annular side wall of the triggering device; and rotating the triggering device to activate a second rotational limit switch with the exterior surface of the triggering device to arrest further rotation of the shaft relative to the housing in the second direction at a predetermined rotational position, wherein the triggering device, the first rotational limit switch, and the second rotational limit switch are supported in a common plane.

17. The method of claim 16, wherein the first and second rotational limit switches are activated by a cam follower on the first and second rotational limit switches interfacing with a raised cam surface on the exterior surface of the triggering device.

* * * * *